US006447320B1

(12) United States Patent
Scholler

(10) Patent No.: US 6,447,320 B1
(45) Date of Patent: Sep. 10, 2002

(54) CONSTRUCTION OF A CIRCULAR AND SOCKET CONNECTOR FOR PRODUCING ELECTRICAL LINE CONNECTIONS

(75) Inventor: Johann Scholler, Deggendorf (DE)

(73) Assignee: Interconnectron GmbH, Deggendorf (DE)

( * ) Notice: Subject to any disclaimer, the term of this patent is extended or adjusted under 35 U.S.C. 154(b) by 0 days.

(21) Appl. No.: 09/650,536

(22) Filed: Aug. 30, 2000

(30) Foreign Application Priority Data

Aug. 31, 1999 (DE) ..... 199 41 518

(51) Int. Cl.[7] ..... H01R 4/38
(52) U.S. Cl. ..... 439/320; 439/273; 439/460
(58) Field of Search ..... 439/320, 460, 439/273, 274, 275, 276, 277

(56) References Cited

U.S. PATENT DOCUMENTS 2,423,276 A * 7/1947 Weissman ..... 439/320
3,603,912 A * 9/1971 William ..... 439/273
3,778,535 A * 12/1973 Forney, Jr. ..... 174/88 C
4,593,962 A * 6/1986 Knorreck et al. ..... 439/277
5,308,259 A * 5/1994 Liao ..... 439/320

* cited by examiner

*Primary Examiner*—Tho D. Ta
*Assistant Examiner*—Truc Nguyen
(74) *Attorney, Agent, or Firm*—Sidley Austin Brown & Wood, LLP

(57) ABSTRACT

A circular plug and socket connector is introduced for producing electrical line connections. In the region of one of its ends it includes a housing, accommodating and holding an insulating base as contact carrier and, in the region of its other end, is includes a sealing cable lead-in and a coupling ring, which makes a screwed connection with a second plug and socket connector half of complementary construction and is mounted rotatably on the outer periphery of the housing and secured against being pulled off in the axial direction and a covering cap fixed mechanically to the housing. In the interests of improving the ease of installation and service, the circular plug and socket connector is distinguished in that a coupling ring, extending over more than the total length of the plug and socket connector half, is supported in the region of its free end, protruding over contact carrier, on a cylindrical peripheral surface of the housing and, in the region of its other end, on a cylindrical longitudinal section of a neck continuation of the covering cap.

3 Claims, 3 Drawing Sheets

CONSTRUCTION OF A CIRCULAR AND SOCKET CONNECTOR FOR PRODUCING ELECTRICAL LINE CONNECTIONS

FIELD OF THE INVENTION

The invention relates to a circular plug and socket connector for producing electrical line connections, consisting of a housing, accommodating and holding, in the region of one of its ends, an insulating base as contact carrier and, in the region of its other end, a sealing cable lead-in, as well as, on the one hand, a coupling ring, which makes possible a screwed connection with a second plug and socket connector half of complementary construction and is mounted rotatably on the outer periphery of the housing and secured against being pulled off in the axial direction and, on the other, a covering cap fixed mechanically to the housing.

BACKGROUND OF THE INVENTION

Such a circular plug and socket connector, forming a component of a two-part plug and socket coupling, is known, for example, from the German Publication No. 197 43 212 and is distinguished essentially by a three-part construction. In this connection, a hollow, cylindrical housing, as a basic body forms the core of the plug and socket connector. The basic housing accommodates the contact carrier together with contact sleeves and is furthermore equipped with a clamping cage or a similar clamping means, which acts in the same way on the cable sheath of the cable that is to be introduced and prevents the cable from being pulled out. At the basic housing, on the one hand, an essentially pot-shaped covering cap, the bottom region of which has an inlet opening for a cable, is fastened, for example, over a clamping device. For the purpose of the intended attainment of a tension-proof connection between the basic housing, the covering cap and the cable sheath, the clamping device must be connected in a rigid manner with the basic body, so that the connection can no longer be undone, at least from the outside, after the installation. Adjacent to the covering cap, an overlapping coupling ring, the end face of which is assigned to the contact carrier, is mounted rotatably on a cylindrical jacket-shaped outer surface of the basic body of the plug and socket coupling. The function of the coupling ring is to produce a tension-resistant connection between one half of the plug and socket coupling and a second half of the plug and socket coupling of a complementary configuration. Due to the relatively large axial longitudinal extent of the covering cap in the case of such a construction of a plug and socket connector coupling, only a relatively small axial length can be provided for the coupling ring. Such an arrangement results in problems relating to the handling of the plug and socket connector coupling, especially in the service area. Since plug and socket connector couplings of this type have to be frequently opened and closed under extremely spatially limited conditions, the short length of the coupling ring, which must be loosened or tightened for the opening or closing of the coupling ring, presents the problem that such loosening or tightening can only be carried out by partial rotations, thus, making the procedure very tedious. This problem is not limited exclusively to the configuration of a plug and socket connector coupling secured by means of a coupling ring as mentioned here, but also arises in all cases, where a coupling ring is used to secure a plug and socket connector coupling.

SUMMARY OF THE INVENTION

It is an object of the invention to improve a circular plug and socket connector of the construction described above so that, while adequate strain relief for the cable is retained, adequate sealing of the housing against moisture and ease of installation and service of the plug and socket connector coupling are improved so that the aforementioned disadvantages are eliminated.

Pursuant to the invention, this objective is accomplished due to the fact that a coupling ring, extending over more than the total length of the plug and socket connector half, is supported in the region of its free end, protruding over the contact carrier, on a cylindrical peripheral surface of the housing and, in the region of its other end, on a longitudinal, cylindrical section of a neck continuation of the covering cap. Irrespective of the problem-free accessibility of the interior of the housing, the inventive insertion of housing, covering cap and coupling ring into one another makes it possible to have a support at both ends and the realization of a long coupling ring, which preferably overlaps at least three quarters of the total length of the plug and socket connector half. Such an arrangement improves the ease of service of the plug and socket connector coupling. The ability to economically produce the circular plug and socket connect arises due to the fact that the assembly of the plug and socket connector requires merely the insertion of the individual, necessary components, such as the contact carriers, optionally the connection of an EMV shielding and a seal or clamping cage for stress relief, into the housing and the subsequent closing of the latter by the covering cap. Simultaneous with the fastening of the covering cap, the components of the plug and socket connector can also be put under tension with respect to one another and with respect to the housing. Overall, the resultant circular plug and socket connector are simple and fast to assemble. Naturally, this also corresponds to savings in time for repair and maintenance work.

In the case of electrical plug and socket connector couplings, which are not identical to the present invention, it is, known from German Publication No. 43 01 504 that the two halves of the plug and socket connector, which belong together, may be equipped with a coupling ring, which extends over the greater part of their axial length. However, this known arrangement of coupling rings is tied, on the one hand, to the use of a housing, which is gated into the cable sheath or connected to water vapor-tight in an equivalent manner with the cable sheath and, on the other hand, unalterably tied to the use of a pull-off safeguard for the coupling ring, disposed at the rear (in the plug-in direction) that is, towards the cable feed-through. Exchanging or repairing individual line connections within the multi-pole plug and socket connector are neither intended nor possible with this known construction.

In a preferred embodiment of the invention, provisions are made for the purpose of ease of service even, in very long coupling rings, that the covering cap, having an opening in its bottom for the passage of a cable, is constructed to embrace the housing and be detachably connected with the housing by a threaded joint. With respect to the construction of the threaded joint, any construction, which is suitable for producing a certain axial clamping force and makes it possible for a problem-free, detachable connection between the covering cap and the housing, may be used for reaching the objective. Preferably however, the threaded joint, for the connection between the covering cap and the housing, comprises at least one screw bolt, which is aligned parallel to the axis of the housing, and at least one corresponding threaded borehole in the housing. This one screw bolt can also be a central screw, which is configured as a hollow screw for the cable feed-through.

However, the configurational shape of the threaded joint between the covering cap and the housing, which is the most technically advantageous in its effort and ease of installation and service, is the threaded joint comprising two screw bolts, which are disposed opposite to one another with respect to a longitudinal center plane of the housing. By known and customary means, the individual screw bolts can also be disposed undetachably in the covering cap.

In connection with such a configuration of the covering cap with the threaded joint for connection with the housing, which may of course, where necessary or appropriate, also comprise more than two screw bolts, a particularly preferred construction of the housing arises from the fact that in each case a threaded borehole, disposed in a rib of the housing protruding radially towards the outside in relation to the general outer periphery of the screw bolt, is assigned to each of the screw bolts forming the screwed joint between the covering cap and the housing. In a further development of this construction of the housing, provisions are then appropriately made so that the thickness of the radially protruding ribs of the housing corresponds to the material thickness of the axial neck continuation of the covering cap and that the axial neck continuation of the covering cap is provided with a number of ribs of the housing, which corresponds to the number of slot recesses. In this connection, in the interests of as large and smooth as possible a cylindrical bearing surface for the, in the plug-in direction, rear region of the coupling ring, further provisions are made so that the outer surface of the ribs, protruding radially with respect to the housing, is curved in such a manner, that it aligns with the external periphery of the neck continuation of the cover cap. This arrangement mode consequently also enables the coupling ring to be arranged unsupported in the region between its front and rear supports. As a result, a pleasant, secure handle feel can be attained even though the coupling ring otherwise has a thin-wall construction.

With regard to sealing the circular plug and socket connector, provisions are made, to begin with, that a cable feed-through, with a seal, adjoining the cable feed-through and lying against the cable sheath, is inserted into the end of the housing opposite the contact carrier and that the cable feed-through, together with the adjoining seal, can be put under tension by means of the covering cap against the inner and face of the housing, so that the installer at the site does not have to devote special attention to the insertion and bracing of the seal. In this connection, it is particularly advantageous that the opening, provided in the bottom part of the covering cap for the entry of the cable, is provided with elements, which protrude radially inward, or with a conical taper which, in collaboration with the seal, bring about a radial compression of the cable sheath forming a strain relief when the covering cap is braced completely against the housing.

A further advantageous development is furthermore seen therein that the coupling ring, in its, in the plug-in direction, front end is supported by means of a radially inwards directed collar at the end surface of the housing and a retaining ring, disposed at a distance from the collar, is secured against being pulled off in the axial direction. Because of this arrangement for safeguarding the coupling ring against being pulled off axially, which lies at the front, the removal of the covering cap is simple and does not require more than the loosening of the bolted connection with the housing. At the same time, this arrangement naturally also results in a simplification of the whole manufacturing effort for the circular plug and socket connector.

In the case of the inventive circular plug and socket connector, the coupling ring by no means has to be constructed in the conventional manner in one piece over its whole length. Rather, a user-friendly configuration of the handle arises out of the fact that the coupling ring is constructed in two parts and comprises a handle body, preferably of a plastic material, and a supporting and bearing body, preferably of a metal, the supporting and bearing body forming the support of the coupling ring at the front end of the housing and also having the radially inward protruding collar as well as the retaining ring catch. In the interests of sufficient durability and strength, provisions can then furthermore be made so that the supporting and bearing body, in an axial continuation, also has the inner thread of the coupling ring.

The various features of novelty which characterize the invention are pointed out with particularity in the claims annexed to and forming a part of this disclosure. For a better understanding of the invention, its operating advantages and specific objects attained by it use, references should be had to the drawings and description matter in which there are illustrated and described preferred embodiments of the invention.

BRIEF DESCRIPTION OF THE DRAWINGS

The invention is described in detail in the following by means of an example, which is shown in the drawing, in which.

DESCRIPTION OF THE PREFERRED EMBODIMENTS

Figure 1:
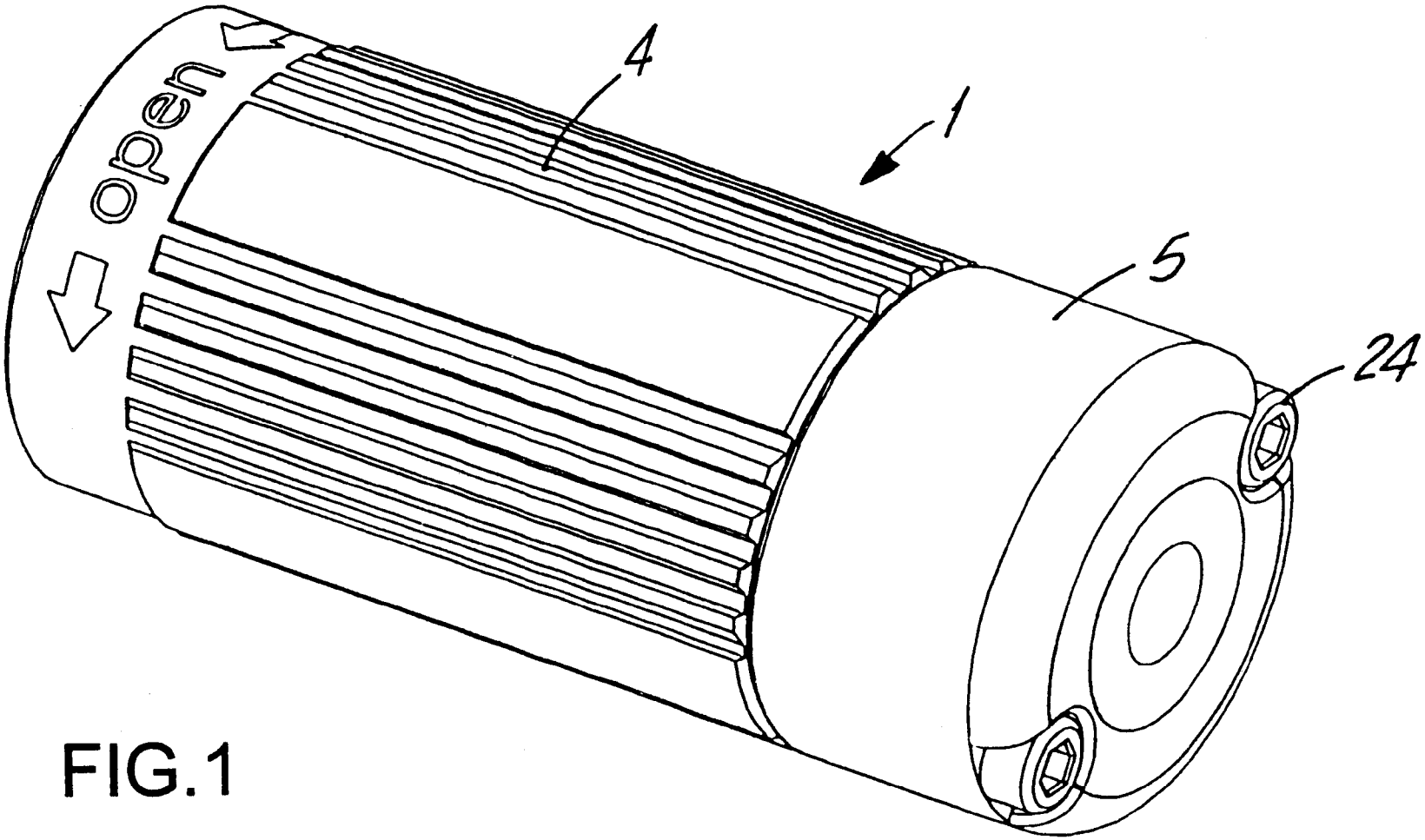
FIG. 1 shows a diagrammatic representation of a circular plug and socket connector.
Figure 2:
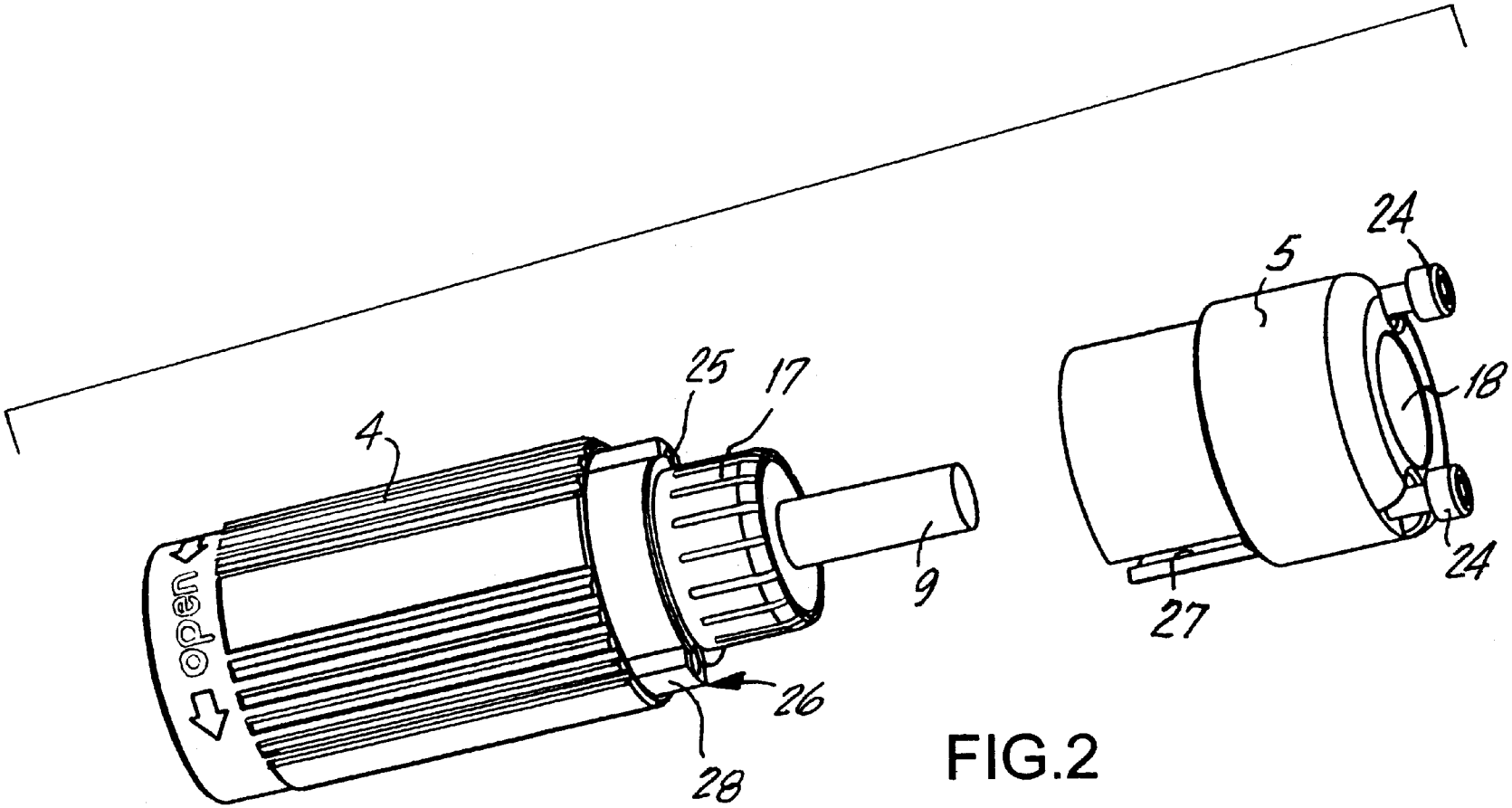
FIG. 2 shows an exploded representation of a circular plug and socket connector of FIG. 1
Figure 3:
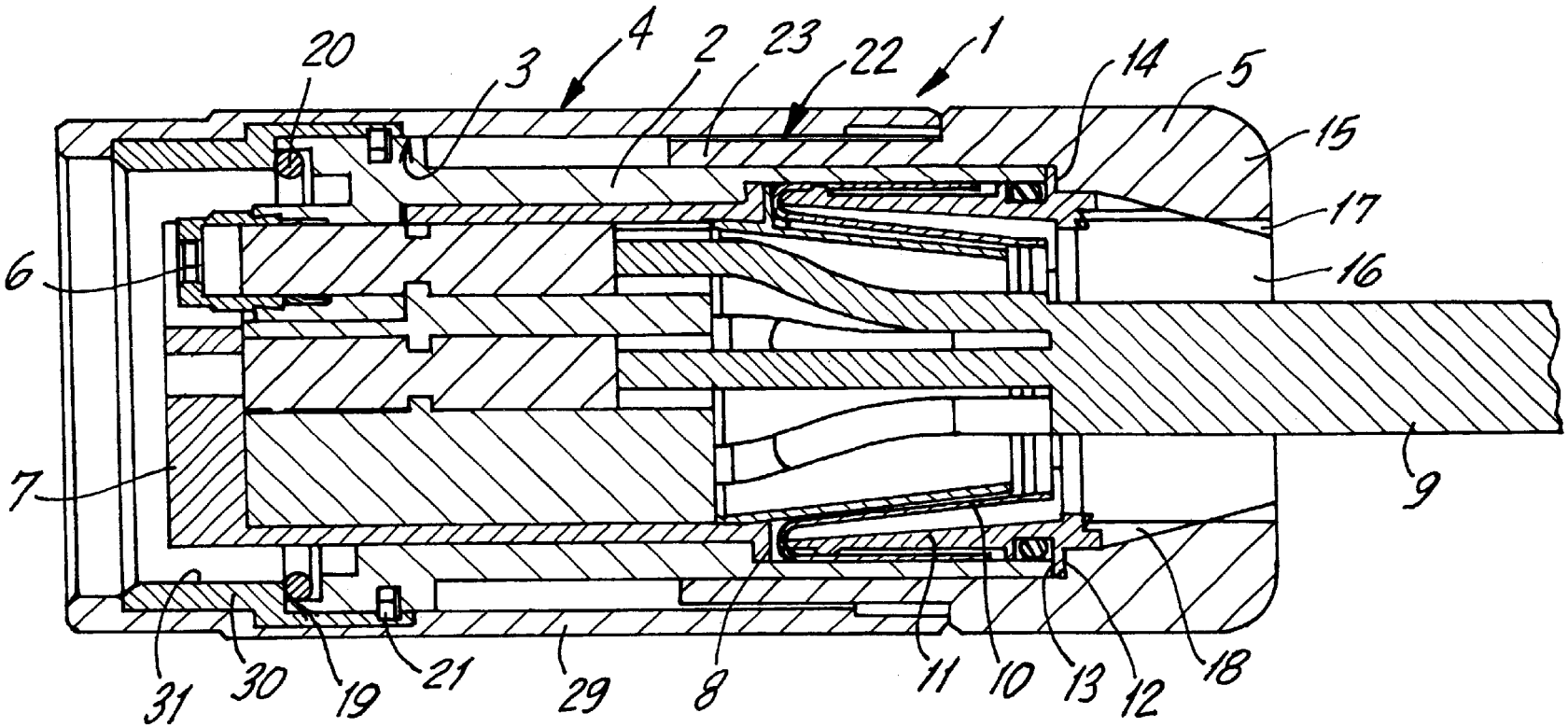
FIG. 3 shows connector of FIG. 1 a longitudinal section through the circular plug and socket

The embodiment of a circular plug and socket connector 1, shown in the drawing, comprises, to begin with, a housing 2, which forms the carrying part of the whole circular plug and socket connector 1, a coupling ring 4, rotatably mounted at a cylindrical peripheral surface 3 of the housing 2 and overlapping the predominant region of the total axial length of the housing 2, and a covering cap 5 overlapping the remaining partial region of the total axial length of the housing 2 of the circular plug and socket connector. In the one end region of the housing 2, formed essentially as a cylindrical accommodating sleeve, a contact carrier 7, equipped with contacts 6, is fixed by means of a collar arrangement 8. Preceding the contact carrier 7 in the inlet direction of the cable 9, a contacting 10 for a cable shielding, which is optionally present but not shown in the drawing, may be provided. In its length within the housing 2 of the circular plug and socket connector 1, the contacting 10 for the cable shielding is held by means of a supporting element 11. The supporting element 11, in turn, on the one hand, lies over a radial collar 12 against the end side 13 of the housing 2 and, on the other, against the inner rear side and engages the collar arrangement 8 for fixing the contact carrier 7 in the housing 2. In its braced position, the supporting element 11 is held by means of a collar 14 of the covering cap 5. In this way, the covering cap 5, to begin with, supports all the aforementioned components 7, 10 and 11 of the circular plug and socket connector 1 at the housing 2. On the other hand, the covering cap 5 has in its bottom part 15 an 18 for the cable, which is configured converging conically towards the outside of the bottom and partially accommodates the seal 16, lying against the cable sheath, as well as a clamping cage 17 for producing a strain relief for the contact connections within the circular plug and socket connector 1. The coupling ring 4, mounted rotatably on the cylindrical peripheral surface 3 of the housing 2, is supported, on one hand, by a radial, inwardly directed collar 19 at the, in the contacting direction, front end surface 20 of the housing 2, and, on the other, is secured against being pulled off in the axial direction by means of a retaining ring 21 supported at the housing 2 of the circular plug and socket connector 1. In the embodiment shown, the coupling ring 4 is supported or mounted rotatably, on the one hand, at its, as seen in the plug-in direction, front end at the peripheral surface 3 of the housing 2 and, on the other, in the region of its end facing the covering cap 5 at a cylindrical peripheral surface 22 of a neck continuation 23 of the covering cap 5 embracing the housing 2 over a certain region. In the region between the two supports 3 and 22, the coupling ring 4 is constructed or disposed cantilevered, which is able to impart a particularly good handling feel, especially in conjunction with the production of the coupling ring 4 from a thin-walled plastic material. As can be seen particularly from the representation of FIG. 2, the screwed union, connecting a covering cap 5 with the housing 2, comprises two screw bolts 24, which lie opposite to one another with respect to the longitudinal middle plane of the housing 2 and to which threaded boreholes 25 are assigned in radially projecting ribs 26 of the housing 2. The screw bolts 24, which are shown in the drawing as socket head cap screws, pass through a drilled recess (not shown) in the bottom 15 of the covering cap 5. As can furthermore be seen from the representation of FIG. 2, slot recesses 27 in the neck continuation 23 of the covering cap 5 are assigned to the ribs 26 of the housing 2. Furthermore, the ribs 26 are cylindrically curved at their outer surface 28, so that they fit flush in the outer peripheral surface of the neck continuation 23 of the covering cap 5. From the representation of FIG. 3, it can furthermore be seen that the coupling ring 4 is constructed in two parts, having a relatively thin-walled handle body 29, which extends for the whole length of the coupling ring 4 and is produced from a plastic material, as well as, in region of its, in the plug-in direction, front end a supporting and bearing body 30, which lines the handle body 29 sectionally. The radial collar 19 and the seat for the retaining ring 21 are also constructed at the supporting and bearing body 30. Furthermore, an internal thread 31 of the coupling ring 4 is likewise accommodated and, moreover, in a continuation of the supporting and bearing body 30.

What is claimed as new and desired to be protected by letters patent is set forth in the appended claims:

What is claimed is:

1. A circular plug and socket connector for producing electrical power connections comprising an insulating part as a contact carrier, at one end; a housing, at an opposite end, for receiving and gripping a cable entry with a seal and having a coupling ring for receiving a complimentarily embodied second plug and socket connect half, wherein the coupling ring is mounted rotatably on an outer periphery of the housing and is secured against being pulled off the housing in an axial direction; and a covering cap detachably fastened to the housing, wherein the coupling ring extends over a great area of an axial length of the housing, whereby the coupling ring, in an area of a free end, protrudes over the contract carrier and is supported on a cylindrical peripheral surface of the housing, and, in an area opposite the free end, is supported on a cylindrical peripheral surface of a neck continuation of the covering cap, wherein a screwed connection for connecting the covering cap with the housing comprises two screw bolts that are disposed opposite to one another with respect to a longitudinal middle plane of the housing and wherein each of a plurality of ribs protruding radially outward with respect to the outer periphery of each of the screw bolts includes one threaded borehole assigned to each of the screw bolts forming the screwed connection between the covering cap and the housing.

2. The circular plug and socket connector of claim 1, wherein the thickness of the radially protruding ribs of the housing corresponds to the thickness of the material of the axial neck continuation of the covering cap and wherein the axial neck continuation of the covering cap includes a number of slot recesses corresponding to the number of ribs.

3. The circular plug and socket connector of claim 2, wherein the outer surface of the ribs are curved such that they are flush with the outer periphery of the neck continuation of the covering cap.

* * * * *